US009649004B2

(12) United States Patent
Houghton et al.

(10) Patent No.: US 9,649,004 B2
(45) Date of Patent: May 16, 2017

(54) STEAM CLEANING DEVICES AND COMPOSITIONS FOR USE THEREWITH

(71) Applicant: BLACK & DECKER INC., Newark, DE (US)

(72) Inventors: Stephen Houghton, Newcastle upon Tyne (GB); Kevin Appleby, Durham (GB); Christopher Hussey, Blaydon on Tyne (GB)

(73) Assignee: BLACK & DECKER INC., New Britain, CT (US)

( * ) Notice: Subject to any disclaimer, the term of this patent is extended or adjusted under 35 U.S.C. 154(b) by 311 days.

(21) Appl. No.: 14/270,999

(22) Filed: May 6, 2014

(65) Prior Publication Data

US 2014/0331443 A1 Nov. 13, 2014

(30) Foreign Application Priority Data

May 10, 2013 (EP) ..... 13167379

(51) Int. Cl.
*A47L 11/34* (2006.01)
*A47L 11/40* (2006.01)
(Continued)

(52) U.S. Cl.
CPC ..... *A47L 11/4086* (2013.01); *A47L 11/34* (2013.01); *A47L 13/225* (2013.01); *C11D 17/0039* (2013.01)

(58) Field of Classification Search
CPC ... A47L 11/34; A47L 11/4086; A47L 13/2225
(Continued)

(56) References Cited

U.S. PATENT DOCUMENTS 2,759,228 A 8/1956 Gordon
4,306,892 A 12/1981 Atalla et al.
(Continued)

FOREIGN PATENT DOCUMENTS

CN 101208036 6/2008
CN 201469205 5/2010
(Continued)

OTHER PUBLICATIONS

Canadian Office Action dated Feb. 26, 2016 for Canadian Application No. 2,851,061.
(Continued)

*Primary Examiner* — David Redding
(74) *Attorney, Agent, or Firm* — John Yun

(57) ABSTRACT

In a first aspect, the present invention provides a steam cleaning device, the device comprising a supply of water for generating steam, and a steam cleaning head for ejecting steam generated from said supply of water in proximity to a surface to be cleaned, wherein the steam cleaning head comprises a portion for receiving a composition adapted to be used in conjunction with such a steam cleaning device, the portion being perfused by steam during ejection by said steam cleaning head of steam generated from said supply of water. This has the advantage that the composition may be changed by a user dependent only on the user's requirements and the rate of consumption of the composition, and independently of both the rate of consumption of water by the steam cleaning device and any need to remove, clean or replace a cleaning cloth mounted on the steam cleaning head. In a second aspect, the present invention also provides an encapsulated composition adapted to be used in conjunction with a steam cleaning device comprising a supply of water for generating steam, wherein the encapsulated composition has a shape adapted to fit a portion of a steam
(Continued)

cleaning head of the steam cleaning device, which portion is perfused by steam during ejection by said steam cleaning head of steam generated from said supply of water. Such a "must-fit" adaptation of the encapsulated composition provides the possibility that only encapsulated compositions suitable for use in a particular steam cleaning device can be charged into that device, in order to ensure correct dosage by the composition of the steam generated by the device.

8 Claims, 10 Drawing Sheets

(51) Int. Cl.
*C11D 17/00* (2006.01)
*A47L 13/22* (2006.01)

(58) Field of Classification Search
IPC ..... A47L 11/34
See application file for complete search history.

(56) References Cited

U.S. PATENT DOCUMENTS

| | | | | |
|---|---|---|---|---|
| 5,087,273 | A | 2/1992 | Ward | |
| 5,104,427 | A | 4/1992 | Riley et al. | |
| 5,415,675 | A | 5/1995 | Powers et al. | |
| 5,511,278 | A | 4/1996 | Shorthill | |
| 5,964,404 | A | 10/1999 | Randolph | |
| 6,131,237 | A | 10/2000 | Kasper et al. | |
| 6,499,183 | B1 | 12/2002 | Paterson et al. | |
| 6,802,879 | B2 | 10/2004 | Scanlon | |
| 6,948,192 | B2 | 9/2005 | Hipponsteel | |
| 8,927,480 | B2 * | 1/2015 | Williams | A47L 13/17 15/228 |
| 2005/0015916 | A1 | 1/2005 | Orubor | |
| 2006/0090290 | A1 | 5/2006 | Lau | |
| 2006/0137529 | A1 | 6/2006 | Emig et al. | |
| 2006/0278087 | A1 | 12/2006 | Sepke et al. | |
| 2007/0130710 | A1 | 6/2007 | Chen et al. | |
| 2010/0186463 | A1 * | 7/2010 | Vrdoljak | A47L 13/22 68/222 |
| 2012/0145191 | A1 | 6/2012 | Williams et al. | |

FOREIGN PATENT DOCUMENTS

| | | |
|---|---|---|
| EP | 2465400 | 6/2012 |
| EP | 2801314 | 11/2014 |
| EP | 2939584 | 11/2015 |
| GB | 2422777 | 8/2006 |
| WO | 9011715 | 10/1990 |
| WO | 2006049499 | 5/2006 |
| WO | WO2006049499 | 5/2006 |
| WO | 2010078513 | 7/2010 |

OTHER PUBLICATIONS

Chinese Office Action dated May 5, 2016, for Chinese Application No. 201410195941.5.
EP Search Report dated Oct. 6, 2015.

* cited by examiner

STEAM CLEANING DEVICES AND COMPOSITIONS FOR USE THEREWITH

CROSS-REFERENCE TO RELATED APPLICATIONS

This application claims priority to European Patent Application No. 13 167 379.0 filed May 10, 2013. The entire contents of that application are expressly incorporated herein by reference.

FIELD OF THE INVENTION

The present invention concerns steam cleaning devices and compositions for use therewith. Steam cleaning devices have become increasingly popular in recent years for performing domestic cleaning tasks. Examples are steam mops for cleaning surfaces like tiled or sealed hardwood floors and hand-held steam cleaners for cleaning surfaces such as kitchen worksurfaces. Use of such steam cleaning devices carries the advantage of a sanitizing or sterilizing effect on the surface being cleaned by application of steam at high temperature. It is already known to use such steam cleaning devices in conjunction with a composition, such as a sanitizing agent having an anti-microbial effect or such as a fragrance, an odor-eliminating or an odor-controlling agent. The composition may be introduced into the steam output from such a steam cleaning device by adding the composition to a reservoir of water in the steam cleaning device, for example in liquid form. The composition becomes mixed with the water, and as water from the reservoir is used by the steam cleaning device to generate steam, the composition is ejected with the steam as the steam cleaning device is used to clean a surface.

BACKGROUND OF THE INVENTION

However, it is also known to introduce a composition into the steam ejected by a steam cleaning device by providing the composition in an encapsulated form. For example, EP 2 465 400 A describes a cleaning cloth for use with a steam mop having a housing for mounting the cloth for cleaning a surface to be cleaned and a steam delivery system for delivering steam to the cleaning cloth. The cleaning cloth has at least one fabric layer which is configured to be attached to a steam mop and an encapsulated cleaning composition associated with the fabric layer and configured to be released by exposure of steam delivered to the cleaning cloth.

Both of the above ways of introducing a composition into the steam ejected by a steam cleaning device have the disadvantage, however, that the usage time of the composition is linked to that of the water supply on the one hand and the cleaning cloth on the other. Thus, if the composition is introduced into the water reservoir of the steam cleaning device, the composition is exhausted at the same time as the reservoir is emptied of water. It is also important for a user to introduce a correct dosage of composition into the reservoir to avoid either an amount of composition which is too low to be effective or which on account of being too high, may leave an undesirable residue or have a damaging effect on the surface to be cleaned. If, however, the composition is provided in encapsulated form associated with a fabric layer of a cleaning cloth in the manner of EP 2 465 400 A, then whenever the cloth needs cleaning or replacing, which may typically happen after only one or two cleaning sessions, then the composition has to be treated in some way by a user at the same time, for example by being removed and replaced, which is also undesirable in terms of rate of usage of the composition, rather than its dosage.

BRIEF SUMMARY OF THE INVENTION

The present invention therefore aims to provide a steam cleaning device and compositions for use therewith, wherein usage of the compositions is decoupled from usage of other elements of the steam cleaning device, such as the amount of water supplied from a reservoir to generate steam, or a cloth used to contact a surface to be cleaned. The present invention also aims to provide an improved steam cleaning device and compositions for use therewith.

Accordingly, in a first aspect, the present invention provides a steam cleaning device, the device comprising a supply of water for generating steam, and a steam cleaning head for ejecting steam generated from said supply of water in proximity to a surface to be cleaned, wherein the steam cleaning head comprises a portion for receiving a composition adapted to be used in conjunction with such a steam cleaning device, the portion being perfused by steam during ejection by said steam cleaning head of steam generated from said supply of water. The supply of water may be either a refillable reservoir or a streamed supply, for example via a hose.

Thus, the composition may be changed by a user dependent only on the user's requirements and the rate of consumption of the composition, and independently of both the rate of consumption of water by the steam cleaning device and any need to remove, clean or replace a cleaning cloth mounted on the steam cleaning head.

Preferably, the portion of the steam cleaning head for receiving the composition is accessible by a user on a first side of the steam cleaning head, which first side is different from a second side of the steam cleaning head adapted to receive a cleaning cloth. This has the additional advantage that a user does not need to handle a dirty cleaning cloth in order to gain access to the portion of the steam cleaning head to charge or replace the composition in the portion.

Preferably, the portion of the steam cleaning head for receiving the composition is a chamber which is openable and closable by a user for charging the chamber with the composition in an open condition thereof, and wherein in a closed condition thereof, the chamber is perfused by steam during ejection by said steam cleaning head of steam generated from said supply of water. This has the advantage of preserving and protecting the composition. Thus the composition may be left in the chamber when the steam cleaning device is stored between cleaning operations without a risk of the composition losing its efficacy through, for example, evaporation of active ingredients from the composition.

Preferably, the chamber is provided with a steam-tight seal, such that in the closed condition of the chamber, steam is unable to escape through an aperture of the chamber through which the composition can be introduced into the chamber in the open condition thereof. This prevents undesirable ejection of steam from the steam cleaning head in a direction other than towards a surface to be cleaned.

Preferably the steam cleaning device is also provided with an interlock mechanism, such that when the chamber is in the open condition, steam generated from the supply of water is prevented from being ejected from the steam cleaning head. This provides a safety feature which protects a user against injury by high-temperature steam when charging or replacing the composition in the portion of the steam cleaning head.

Alternatively or additionally, the chamber may be provided with a time delay mechanism, which prevents a user from putting the chamber in the open condition thereof until after steam residing in the chamber has subsided or cooled to a predetermined level. This predetermined level is desirably chosen to be below that at which the steam presents a risk of injury to the user. Such a time-delay mechanism may take the form of a simple twist-and-lock cap requiring several turns before the open condition is reached, for example.

In a second aspect, the present invention also provides an encapsulated composition adapted to be used in conjunction with a steam cleaning device comprising a supply of water for generating steam, wherein the encapsulated composition has a shape adapted to fit a portion of a steam cleaning head of the steam cleaning device, which portion is perfused by steam during ejection by said steam cleaning head of steam generated from said supply of water. Such a "must-fit" adaptation of the encapsulated composition provides the possibility that only encapsulated compositions suitable for use in a particular steam cleaning device can be charged into that device, in order to ensure correct dosage by the composition of the steam generated by the device.

Moreover, the encapsulated composition may be of a particular shape which is not only adapted to fit the portion of the steam cleaning head, but which is also adapted to mount securely to that portion. For example, the encapsulated composition may be provided with a thread that allows it to twist and lock on to the portion of the steam cleaning head, or it may be adapted to click into the portion of the steam cleaning head in a friction fit. Alternatively or additionally, the encapsulated composition may comprise an inert carrier part which is adapted to mount securely to the portion of the steam cleaning head. For example, the carrier part may be a steam-resistant plastics part of the encapsulated composition having a particular shape adapted to fit the portion of the steam cleaning head, which carrier part contains the active ingredients of the composition therein. This has the advantage that a user need only handle the inert carrier part of the encapsulated composition when charging or replacing the composition in the portion of the steam cleaning head.

BRIEF DESCRIPTION OF THE DRAWINGS

Further features and advantages of the present invention will become apparent from the followed detailed description of the invention, which is given by way of example and in association with the accompanying drawings, in which.

DETAILED DESCRIPTION OF THE INVENTION

Figure 1:
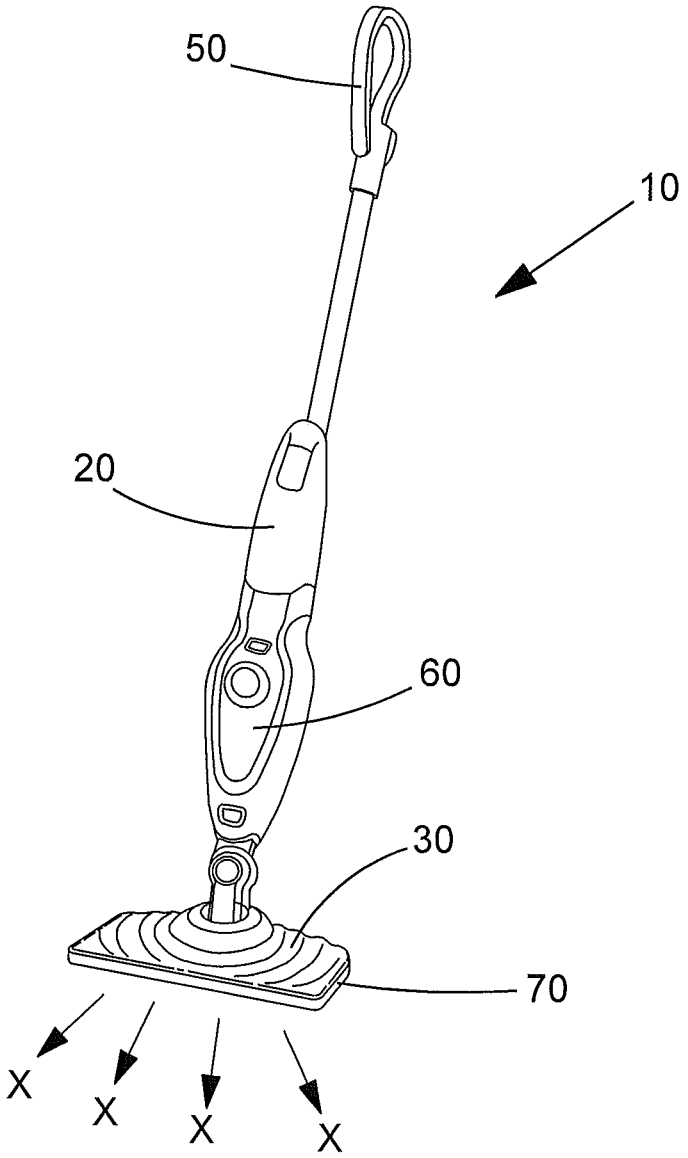
FIG. 1 is a general view of a steam cleaning device having a steam cleaning head.

Looking firstly at FIG. 1, there is shown a steam cleaning device 10 comprising a supply of water for generating steam in the form of a refillable reservoir 20 and a steam cleaning head 30 for ejecting steam generated from said supply of water in proximity to a surface to be cleaned. The steam cleaning device 10 also comprises a handle 50 and a main body portion 60, the latter of which contains a boiler for converting water supplied form reservoir 20 into steam and supplying the steam thus generated to steam cleaning head 30, whence the steam exits in the directions generally indicated by the arrows labelled X in FIG. 1. Mounted on steam cleaning head 30 is a cleaning cloth 70 for cleaning a surface to be cleaned.

Figure 2:
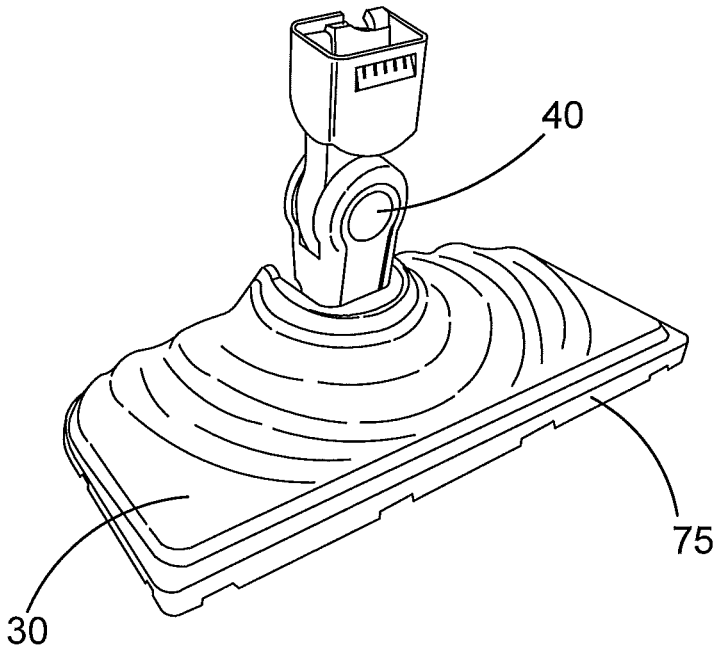
FIG. 2 is a closer view of the steam cleaning head of the steam cleaning device shown in FIG. 1.

FIG. 2 is a closer view of the steam cleaning head 30 of the steam cleaning device 10 shown in FIG. 1, in which it may be seen that the head 30 includes a pivoting universal joint 40 for moving the head 30 over a surface to be cleaned in directions desired by a user holding handle 50 of the steam cleaning device 10. The steam cleaning head 30 also comprises a frame 75 for mounting cleaning cloth 70 thereto.

Figure 3A:
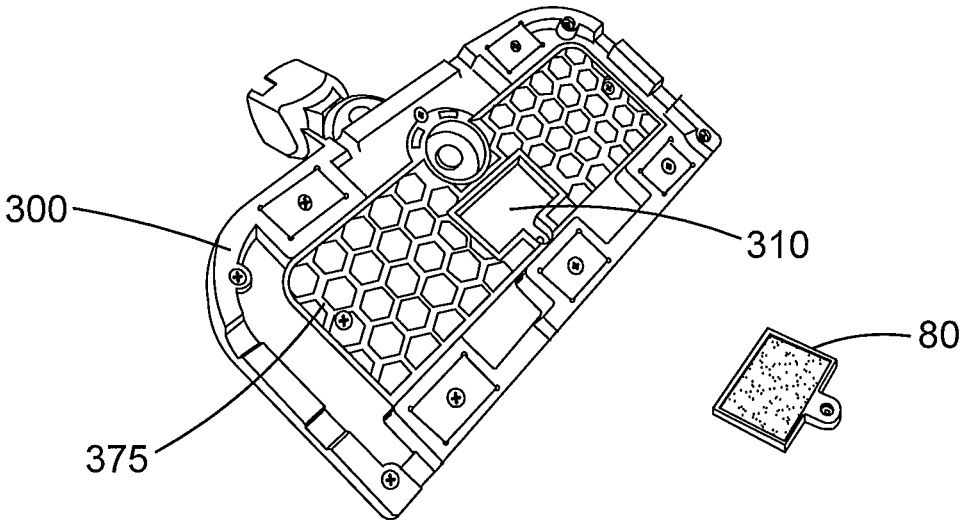
FIG. 3A shows the underside of a steam cleaning head according to a first embodiment of the invention and an encapsulated composition for use therewith.
Figure 3B:
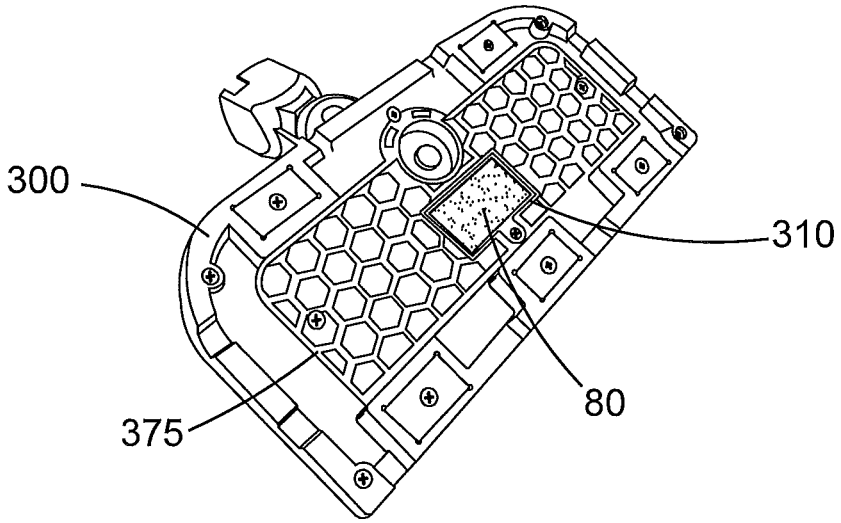
FIG. 3B shows the steam cleaning head of FIG. 3A charged with the encapsulated composition of FIG. 3A.

Next turning to FIG. 3A, there is shown the underside of a steam cleaning head 300 according to a first embodiment of the invention and an encapsulated composition 80 for use therewith. The steam cleaning head 300 comprises a portion 310 for receiving the encapsulated composition 80 which is adapted to be used in conjunction with a steam cleaning device having such a head 300. Steam cleaning head 300 also comprises a frame 375 for mounting a cleaning cloth thereto. As may be seen in FIG. 3A, the frame 375 is slightly raised from a main body of the steam cleaning head 300 to leave an air gap there between. Thus, when the steam cleaning head 300 is charged with the encapsulated composition 80 in the manner shown in FIG. 3B, the portion 310 is perfused by steam during ejection by the steam cleaning head 300 of steam generated from a supply of water of a steam cleaning device to which the head 300 is attached.

Figure 4:
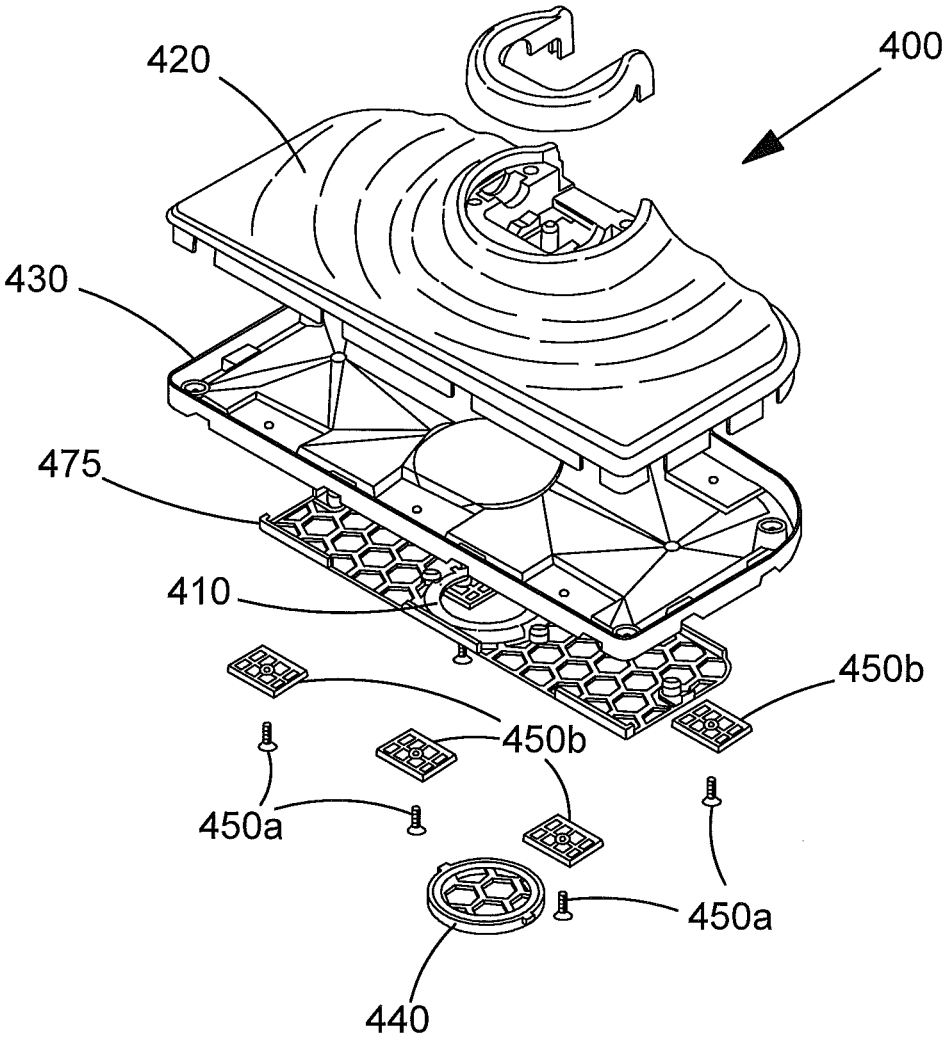
FIG. 4 is an exploded view of a steam cleaning head according to a second embodiment of the invention.

FIG. 4 is an exploded view of a steam cleaning head 400 according to a second embodiment of the invention. The head 400 comprises an upper body portion 420, a lower body portion 430 and a frame 475 for mounting a cleaning cloth thereto. The frame 475 includes a portion 410 for receiving an encapsulated composition. The portion 410 has a twist-and-lock cover 440, which is removable by a user, thus making portion 410 openable and closable by a user. The upper body portion 420, the lower body portion 430 and the frame 475 are assembled and held together by tamper-proof screws 450*a* and respectively associated mounting plates 450*b*.

Figure 5A:
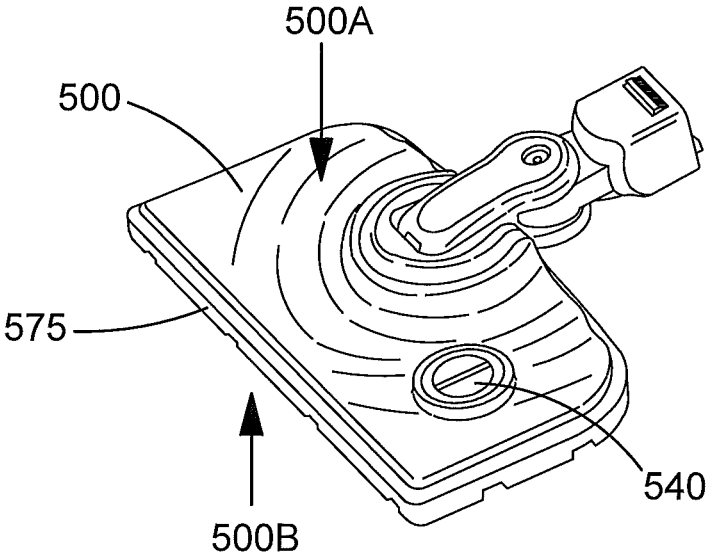
FIG. 5A shows a steam cleaning head according to a third embodiment of the invention with a chamber thereof in a closed condition.
Figure 5B:
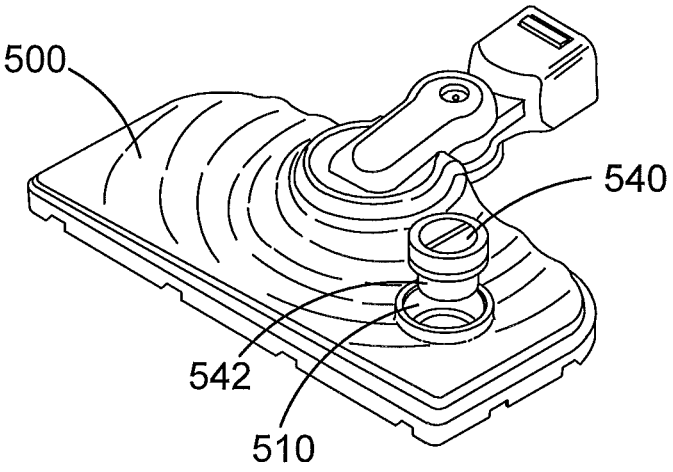
FIG. 5B shows the steam cleaning head of FIG. 5A with the chamber thereof in an open condition.

FIG. 5A shows a steam cleaning head 500 according to a third embodiment of the invention. The steam cleaning head 500 comprises a portion for receiving an encapsulated composition in the form of a chamber 510, visible in FIG. 5B. In this embodiment, the portion 510 of the steam cleaning head 500 for receiving the composition is accessible by a user on a first side of the steam cleaning head, indicated in FIG. 5A by an arrow labelled 500A, which first side is different from a second side of the steam cleaning head adapted to receive a cleaning cloth, indicated in FIG. 5A by an arrow labelled 500B. In this particular embodiment, the first side 500A is opposite to the second side 500B. The steam cleaning head 500 also comprises a frame 575 for mounting the cleaning cloth thereto on side 500B. Thus a user does not need to handle a dirty cleaning cloth in order to gain access to the portion 510 of the steam cleaning head 500 for receiving an encapsulated composition in order to charge or replace the composition in the portion.

Figure 5C:
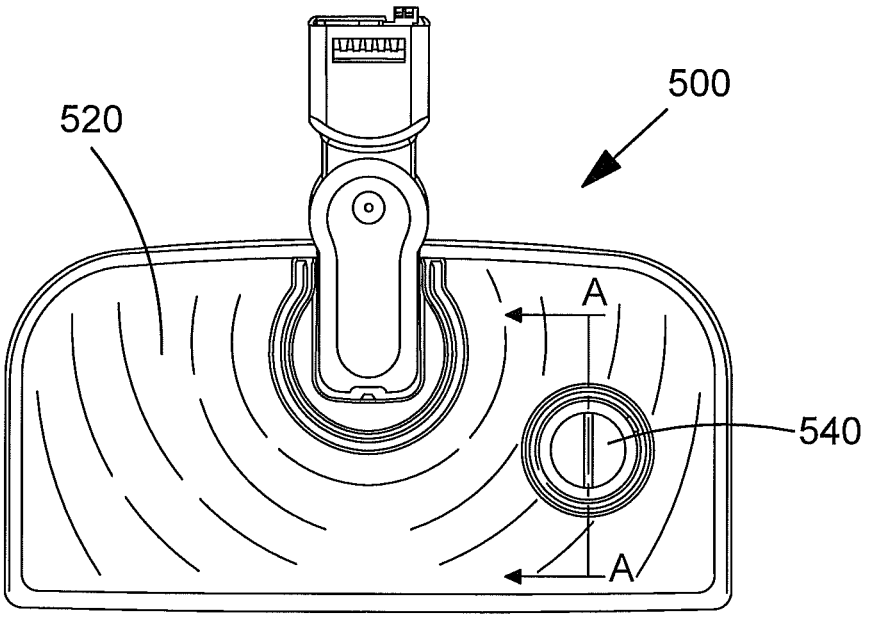
FIG. 5C is a plan view of the steam cleaning head shown in FIG. 5A.
Figure 5D:
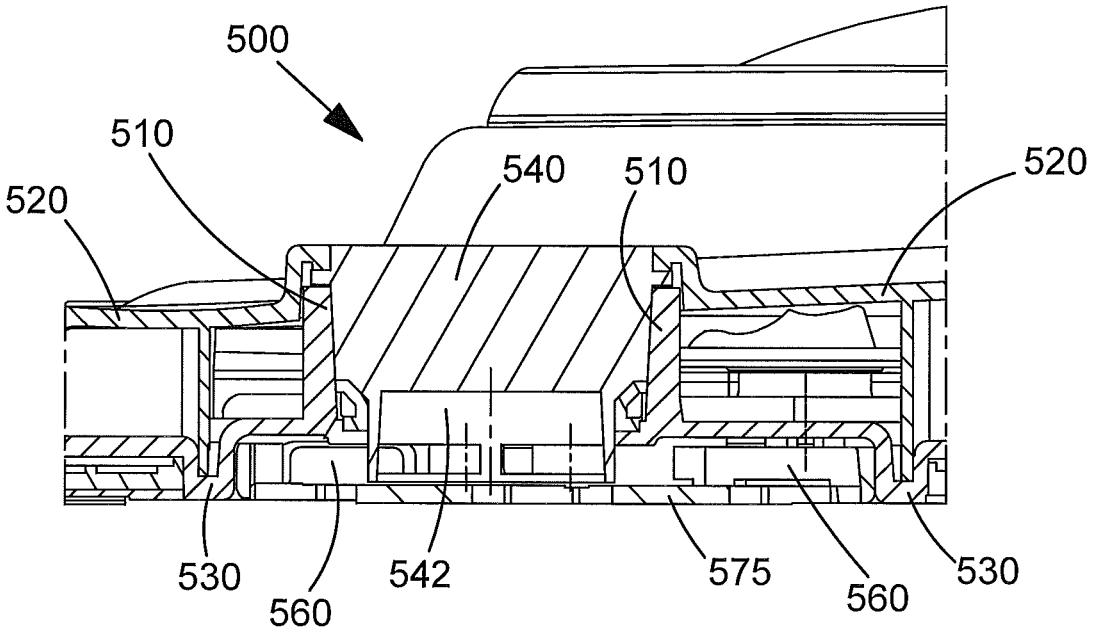
FIG. 5D is a cross-sectional view of the steam cleaning head shown in FIG. 5A along the line A-A shown in FIG. 5C.

Chamber 510 is closable by means of a cap 540, since a user can screw cap 540 into chamber 510 in a twist-and-lock manner. Chamber 510 is shown in a closed condition thereof in FIG. 5A when cap 540 is inserted into chamber 510 and in an open condition thereof in FIG. 5B when cap 540 is removed from chamber 510. As can also be seen in FIG. 5B, cap 540 comprises a compartment 542 for receiving the encapsulated composition therein. The encapsulated composition has a shape adapted to fit into compartment 542. How active ingredients in the encapsulated composition dose steam ejected from the steam cleaning head 500 may best be seen by reference to FIGS. 5C and 5D. FIG. 5C is a plan view of steam cleaning head 500 showing a top surface of an upper body portion 520 thereof and an upper surface of cap 540, and FIG. 5D is a cross-sectional view of the same steam cleaning head 500 along the line A-A shown in FIG. 5C. As may be seen in FIG. 5D, the compartment 542 of cap 540 protrudes into an air gap 560 located between a lower body portion 530 of steam cleaning head 500 and the frame 575 for mounting a cleaning cloth thereto. Thus, in a closed condition of chamber 510, during ejection of steam from the steam cleaning head 500, the steam travels along the air gap 560 between lower body portion 530 and frame 575, and the chamber 510, including the compartment 542, is perfused with steam. Upon contact with steam, active ingredients within the encapsulated composition contained within compartment 542 are released into the steam. On the other hand, when the steam mop is not in use for a cleaning operation and is placed in storage, provided that a cleaning cloth remains mounted to frame 575, an encapsulated composition contained within compartment 542 is preserved and protected from the external environment.

Figure 5E:
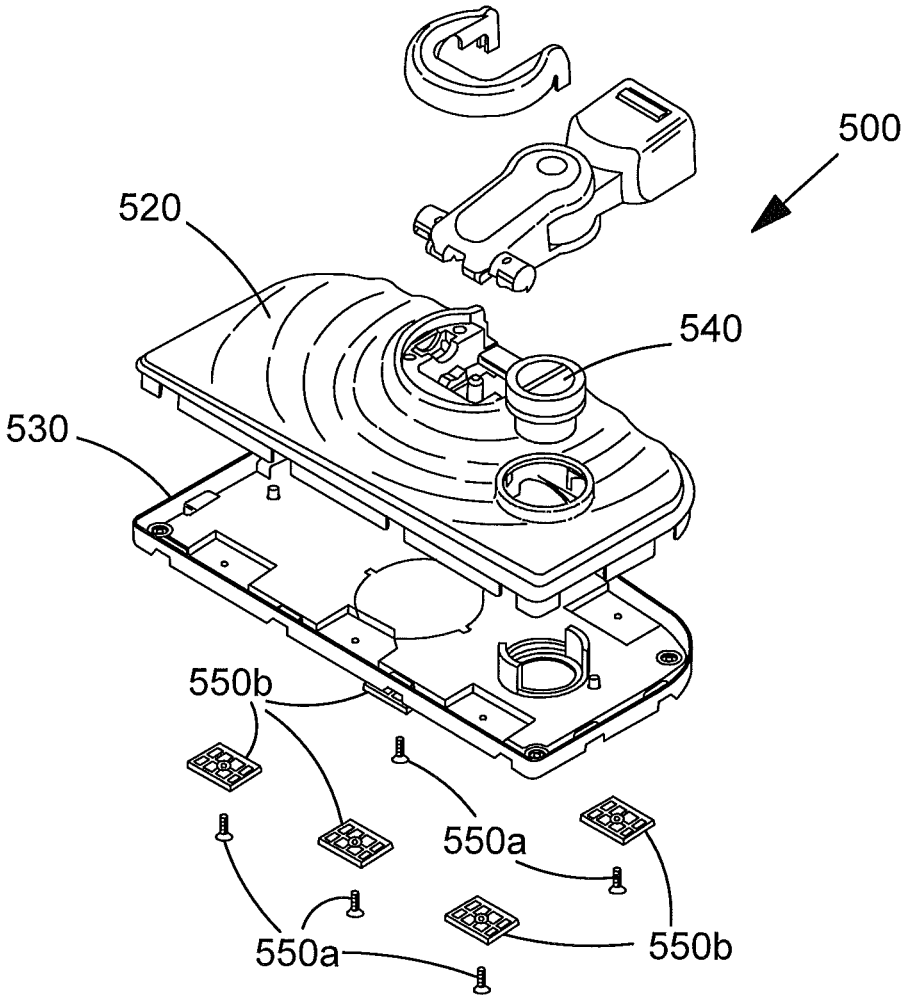
FIG. 5E is an exploded view of the steam cleaning head shown in FIG. 5A.

FIG. 5E is an exploded view of steam cleaning head 500, wherein frame 575 has been removed. As in the second embodiment described above, the upper body portion 520, the lower body portion 530 and the frame 575 of steam cleaning head 500 are assembled and held together by tamper-proof screws 550*a* and respectively associated mounting plates 550*b*.

Figure 6A:
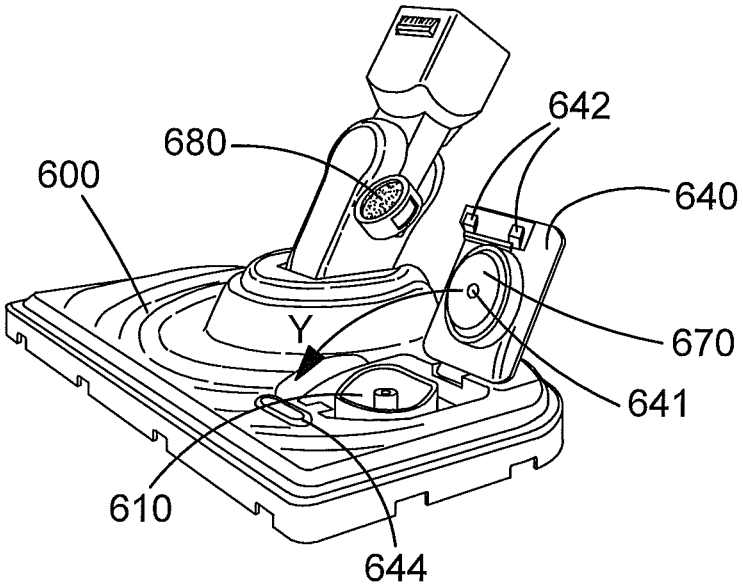
FIG. 6A shows a steam cleaning head according to a fourth embodiment of the invention with an encapsulated composition for use therewith.
Figure 6B:
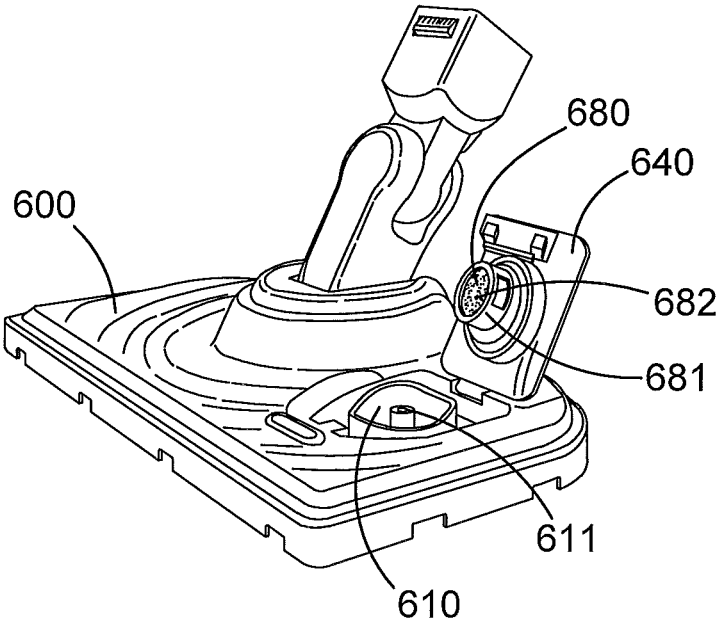
FIG. 6B shows the steam cleaning head of FIG. 6A charged with the encapsulated composition of FIG. 6A.

FIGS. 6A and 6B show a steam cleaning head 600 according to a fourth embodiment of the invention, together with an encapsulated composition 680 for use therewith. The steam cleaning head 600 comprises a portion for receiving the encapsulated composition 680 in the form of a chamber 610 closable by a flip-up lid 640. FIGS. 6A and 6B both show chamber 610 in an open condition thereof, wherein flip-up lid 640 exposes chamber 610 for access by a user, but chamber 610 may also be placed back in a closed condition thereof by a user moving flip-up lid 640 in a direction indicated by arrow Y in FIG. 6A, until a pair of catches 642 on an underside of lid 640 engage with a pair of corresponding detents located within chamber 610 (detents not visible in FIGS. 6A and 6B). The flip-up lid 640, which is spring-loaded, may be placed back in the open condition again by a user operating a spring-loaded release sliding switch 644 which inter-engages with the detents. On an underside of flip-up lid 640 is provided a steam-tight seal 670 made of a steam-resistant but resilient elastomeric material, such that in a closed condition of the chamber 610, steam is unable to escape through an aperture of the chamber through which the encapsulated composition 680 can be introduced into the chamber 610 in the open condition thereof. The encapsulated composition 680 not only has a shape adapted to fit the chamber 610, but is also adapted to mount securely thereto by attachment to the underside of flip-up lid 640. Specifically, encapsulated composition 680 comprises an inert carrier part 681 containing the active ingredients 682 of the encapsulated composition therein, and the inert carrier part 681 has a nipple formed thereon, which nipple can be inserted by a user into a corresponding hole 641 formed in the centre of lid 640 in a friction fit. When the lid 640 is placed in the closed condition, a conduit punctures the inert carrier part 681 to release the active ingredients 682 into steam ejected by steam cleaning head 600.

Figure 7A:
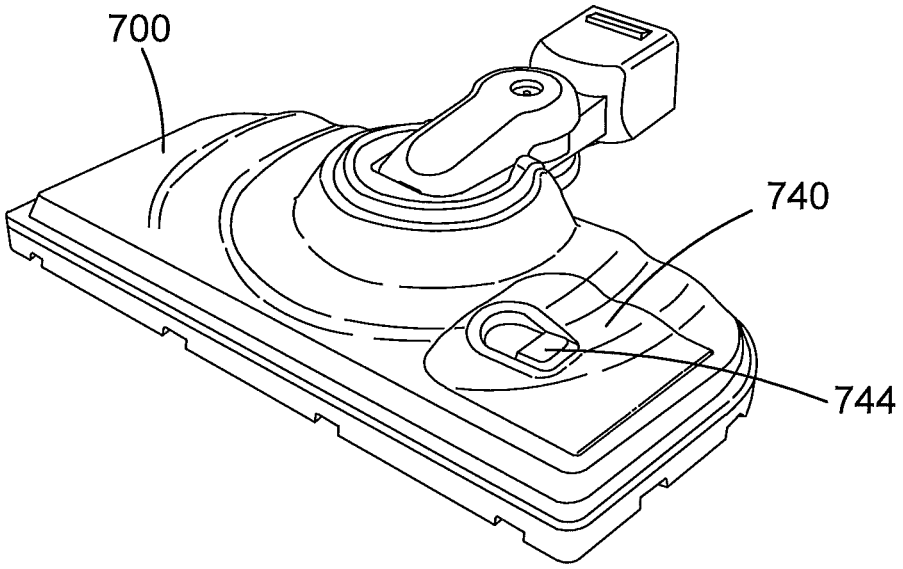
FIG. 7A shows a steam cleaning head according to a fifth embodiment of the invention with a chamber thereof in a closed condition.
Figure 7B:
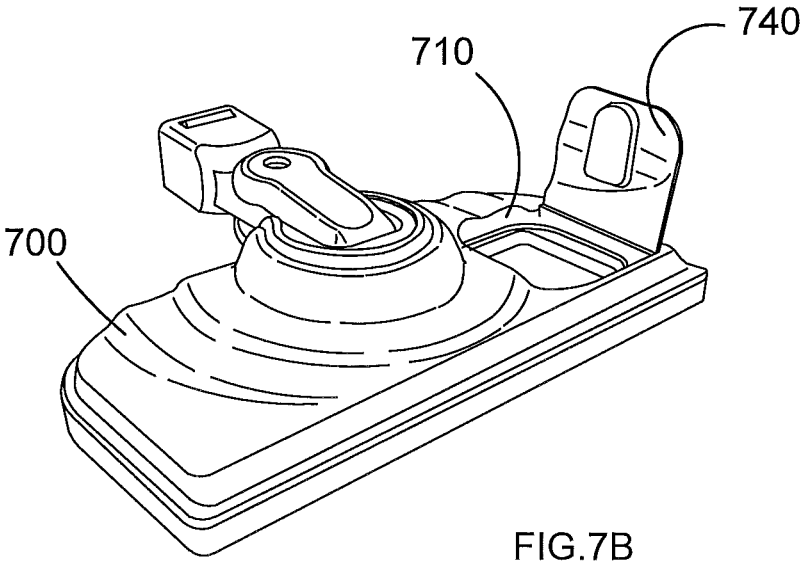
FIG. 7B shows the steam cleaning head of FIG. 7A with the chamber thereof in an open condition and charged with an encapsulated composition.
Figure 7C:
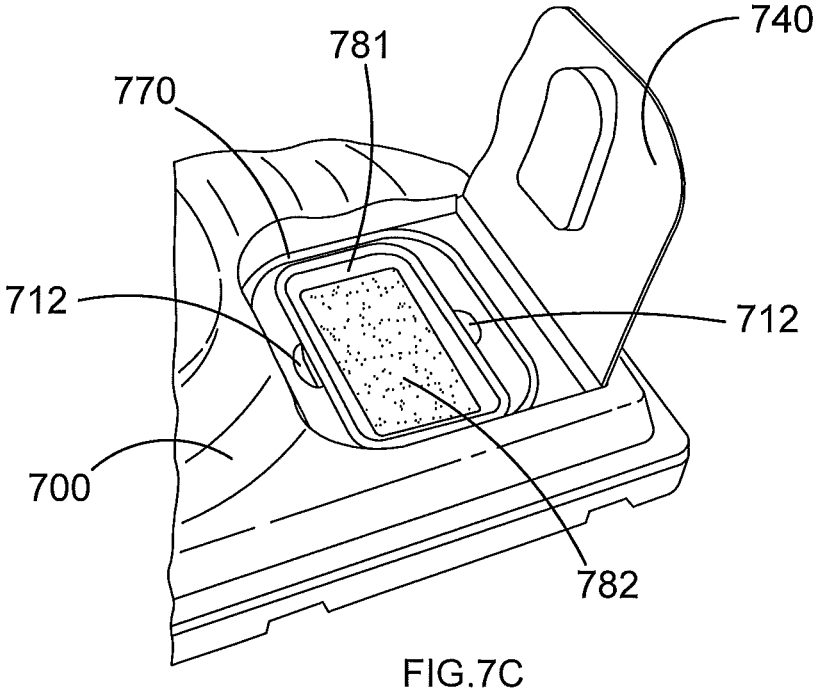
FIG. 7C is a close-up view of FIG. 7B.
Figure 7D:
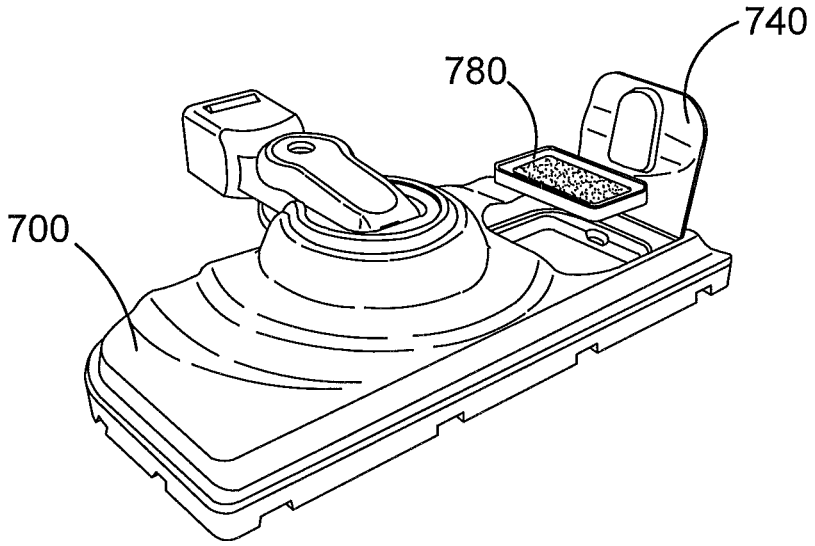
FIG. 7D shows the encapsulated composition of FIGS. 7C and 7D removed from the steam cleaning head of FIGS. 7C and 7D.

FIGS. 7A to 7D show a steam cleaning head 700 according to a fifth embodiment of the invention, together with an encapsulated composition 780 for use therewith. The steam cleaning head 700 comprises a portion for receiving the encapsulated composition 780 in the form of a chamber 710 closable by a flip-up lid 740. FIG. 7A shows the chamber 710 in a closed condition thereof when the flip-up lid 740 is flush with an upper surface of the steam cleaning head 700 and FIG. 7B shows the chamber 710 in an open condition thereof when the flip-up lid 740 is raised by operation by a user of a spring-loaded release slider 744 provided in an upper surface of lid 740 and operable in a similar manner by a user to the spring-loaded release sliding switch 644 of the fourth embodiment described previously. As may be seen in FIG. 7C, the encapsulated composition 780 comprises an inert carrier part 781 which contains the active ingredients 782 of the composition therein. The inert carrier part 781 is made of a steam-resistant plastics material which has a particular shape adapted to fit the chamber 710 in a friction fit by insertion of the encapsulated composition 780 therein by a user. The chamber 710 also comprises a pair of recesses 712 which allow a user to only handle the inert carrier part 781 of the encapsulated composition 780 when charging or replacing the composition in the chamber 710. FIG. 7D shows the encapsulated composition 780 removed from the chamber 710 in this manner. Finally, as may be seen in FIG. 7C, the rim of the chamber 710 is also provided with a steam-tight seal 770 made of a steam-resistant but resilient elastomeric material, such that in a closed condition of the chamber 710, steam is unable to escape through an aperture of the chamber through which the encapsulated composition 780 is introduced into the chamber 710 by a user in the open condition thereof.

The invention claim is:

1. A steam cleaning device comprising:

a supply of water for generating steam; and a steam cleaning head for ejecting steam generated from said supply of water in proximity to a surface to be cleaned, the steam cleaning head having a top portion and a bottom portion;

wherein the top portion of the steam cleaning head provides access to a chamber and is adapted to receive a composition for use in conjunction with such a steam cleaning device, the chamber being accessible while a cleaning cloth is attached to the steam cleaning head, the composition being perfused by steam during ejection by said steam cleaning head of steam generated from said supply of water;

wherein the bottom portion of the steam cleaning head is covered by the cleaning cloth for cleaning a surface.

2. The steam cleaning device according to claim 1, wherein the chamber is openable and closable by a user for charging the chamber with the composition in an open condition thereof, and wherein in a closed condition thereof, the chamber is perfused by steam during ejection by said steam cleaning head of steam generated from said supply of water.

3. A steam cleaning device comprising:

a supply of water for generating steam;

a steam cleaning head for ejecting steam generated from said supply of water in proximity to a surface to be cleaned;

wherein the steam cleaning head comprises a portion for receiving a composition adapted to be used in conjunction with such a steam cleaning device, the portion being perfused by steam during ejection by said steam cleaning head of steam generated from said supply of water;

wherein the portion of the steam cleaning head for receiving the composition is accessible by a user on a first side of the steam cleaning head, which first side is different from a second side of the steam cleaning head adapted to receive a cleaning cloth;

wherein the portion of the steam cleaning head for receiving the composition is a chamber which is openable and closable by a user for charging the chamber with the composition in an open condition thereof, and wherein in a closed condition thereof, the chamber is perfused by steam during ejection by said steam cleaning head of steam generated from said supply of water; and wherein the chamber is provided with a steam-tight seal, such that in the closed condition of the chamber, steam is unable to escape through an aperture of the chamber through which the composition can be introduced into the chamber in the open condition thereof.

4. The steam cleaning device according to claim 3, wherein the steam cleaning device further comprises an interlock mechanism, such that when the chamber is in the open condition, steam generated from the supply of water is prevented from being ejected from the steam cleaning head.

5. The steam cleaning device according to claim 4, wherein the chamber further comprises a time delay mechanism preventing a user from putting the chamber in the open condition thereof until after steam residing in the chamber has subsided or cooled to a predetermined level.

6. The steam cleaning device according to claim 1, further comprising the composition adapted to be used with the steam cleaning device, wherein the composition is encapsulated and has a shape adapted to fit in the chamber of the steam cleaning head of the steam cleaning device.

7. The steam cleaning device according to claim 6, wherein the encapsulated composition is adapted to mount securely to said portion of the steam cleaning head.

8. The steam cleaning device according to claim 7, wherein the encapsulated composition comprises an inert carrier part adapted to mount securely to said portion of the steam cleaning head.

* * * * *